US009863618B2

(12) United States Patent
Ngai et al.

(10) Patent No.: US 9,863,618 B2
(45) Date of Patent: Jan. 9, 2018

(54) CONFIGURABLE PLANAR LIGHTING SYSTEM

(71) Applicant: ABL IP Holding, LLC, Conyers, GA (US)

(72) Inventors: Peter Y. Y. Ngai, Alamo, CA (US); Michael Trung Tran, Oakland, CA (US)

(73) Assignee: ABL IP Holding, LLC, Conyers, GA (US)

( * ) Notice: Subject to any disclaimer, the term of this patent is extended or adjusted under 35 U.S.C. 154(b) by 233 days.

(21) Appl. No.: 14/727,637

(22) Filed: Jun. 1, 2015

(65) Prior Publication Data

US 2015/0345757 A1 Dec. 3, 2015

Related U.S. Application Data

(60) Provisional application No. 62/005,852, filed on May 30, 2014.

(51) Int. Cl.

| | |
|---|---|
| ***F21V 21/00*** | (2006.01) |
| ***F21V 21/35*** | (2006.01) |
| *F21V 21/096* | (2006.01) |
| *F21S 8/00* | (2006.01) |
| *F21Y 105/00* | (2016.01) |
| *F21Y 115/15* | (2016.01) |

(52) U.S. Cl.
CPC ..... *F21V 21/35* (2013.01); *F21S 8/03* (2013.01); *F21V 21/096* (2013.01); *F21Y 2105/00* (2013.01); *F21Y 2115/15* (2016.08)

(58) Field of Classification Search
CPC .... F21S 4/001; F21Y 2105/00; F21Y 2105/16
USPC ..... 235/249.01
See application file for complete search history.

(56) References Cited

U.S. PATENT DOCUMENTS

| | | | | |
|---|---|---|---|---|
| D406,916 | S | 3/1999 | Klaus | |
| 6,413,645 | B1 * | 7/2002 | Graff | B32B 27/00 426/126 |
| 6,537,688 | B2 * | 3/2003 | Silvernail | B32B 3/00 136/251 |
| 6,777,871 | B2 * | 8/2004 | Duggal | B82Y 20/00 313/504 |
| 7,175,296 | B2 | 2/2007 | Cok | |
| 7,182,637 | B2 | 2/2007 | Coyle, Jr. et al. | |

(Continued)

*Primary Examiner* — Daniel St Cyr
(74) *Attorney, Agent, or Firm* — Beeson Skinner Beverly, LLP

(57) ABSTRACT

A configurable planar lighting system includes a system track and at least one, and preferably more than one, very thin profile planar light module attachable at selectable positions along the system track. The thin profile planar light module holds a very thin area light source, which is electrified when the planar fixture module is attached to the system track. The configurable planar lighting system can be mounted and configured on a wall without surrounding structures or to the underside of a counter, cabinet, shelf or the like. The configurable planar lighting system can also act as a shelf for light objects such as decorative objects, and can be used for task lighting or display lighting or both in versatile configurations. In under-structure applications, the lighting system can be mounted to provide configurable lighting without the physical parts of the system being visible at normal viewing angles.

27 Claims, 9 Drawing Sheets

(56) References Cited

U.S. PATENT DOCUMENTS

| | | | | |
|---|---|---|---|---|
| 7,384,166 | B2 | 6/2008 | Tress et al. | |
| 7,547,112 | B2 | 6/2009 | Kim | |
| 8,215,795 | B2 | 7/2012 | Pichel | |
| 8,450,926 | B2 | 5/2013 | Roberts et al. | |
| 8,485,700 | B2 | 7/2013 | Ngai | |
| 9,494,293 | B2 * | 11/2016 | Pickard | F21V 15/013 |
| 2002/0136001 | A1 * | 9/2002 | Lefkovitz | E04B 9/006 362/147 |
| 2007/0121314 | A1 | 5/2007 | Sanborn et al. | |

* cited by examiner

CONFIGURABLE PLANAR LIGHTING SYSTEM

CROSS-REFERENCE TO RELATED APPLICATIONS

This application claims the benefit of U.S. Provisional Application No. 62/005,852 filed May 30, 2014.

BACKGROUND

The present invention generally relates to lighting systems and more particularly to lighting systems having an electrified track to which lighting elements can be attached in different arrangements to change lighting patterns or placements in a space.

Track lighting systems are well known and are conventionally comprised of an electrified track. Lamps, typically for spotlighting, can be attached anywhere along the length of the track for placement at desired lamp locations. The lamps of such track lighting systems are generally protruding lamps which mechanically connect, such as with stab-lock connectors, to the track, and which are readily visible to persons within the space where the lighting system is installed. Conventional track lighting systems lack a form that would be well-suited for applications where it is desired to conceal the light sources, such as under-cabinet or counter lighting, or where shelf-like planar forms are desired.

The present invention provides a configurable lighting system having a thin profile planar shelf-like form that is adapted to a number of applications where conventional lighting systems cannot be used. The lighting system of the invention allows very thin planar light modules to be readily configured along a track to permit the modules to invisibly fit underneath cabinets, counters, shelves and other horizontal structures, or to create a versatile shelf-like lighting system on a wall or other vertical surface.

SUMMARY OF INVENTION

The invention is directed to a configurable planar lighting system that includes a system track and at least one, and preferably more than one, very thin profile planar light module attachable at selectable positions along the system track. The thin profile planar light module holds a very thin area light source, preferably a thin OLED panel, which is electrified when the planar fixture module is attached to the system track. The configurable planar lighting system can be mounted and configured on a wall without surrounding structures or to the underside of a counter, cabinet, shelf or the like. The configurable planar lighting system can also act as a shelf for light objects such as decorative objects, and can be used for task lighting or display lighting or both in versatile configurations. In under-structure applications, the lighting system can be mounted to provide configurable lighting without the physical parts of the system being visible at normal viewing angles.

In one aspect of the invention, the light modules of the configurable planar lighting system can be magnetically attached to the system track without the need for mechanical connectors. This allows the light modules to be readily attached to, removed from or moved along the track when configuring the lighting system.

BRIEF DESCRIPTION OF THE DRAWINGS

FIG. 5 is intended to illustrate the general configuration of the top of the extension plate of the light module, and the location of the magnets on the base edge of the module.

DETAILED DESCRIPTION OF THE ILLUSTRATED EMBODIMENT

Figure 1:
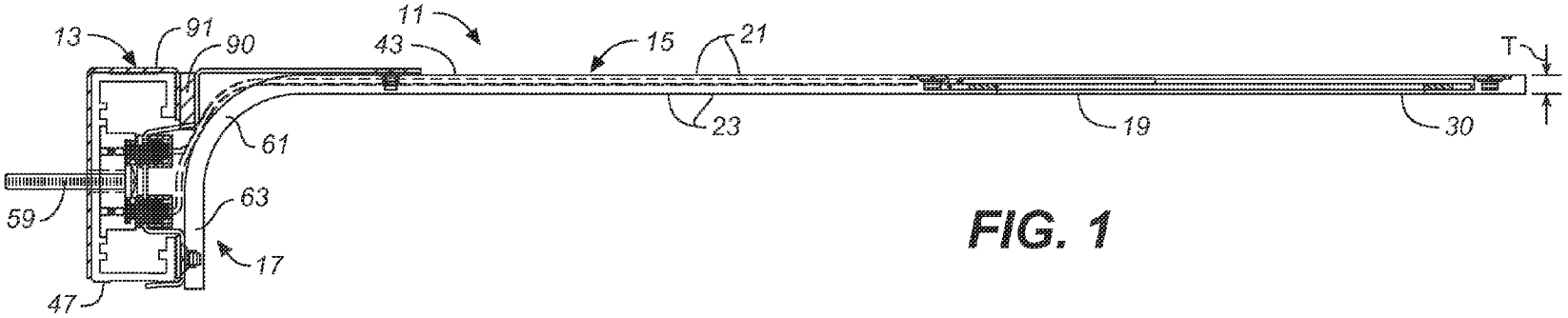
FIG. 1 is a side elevational view in cross section of a configurable planar lighting system in accordance with the invention.
Figure 2:
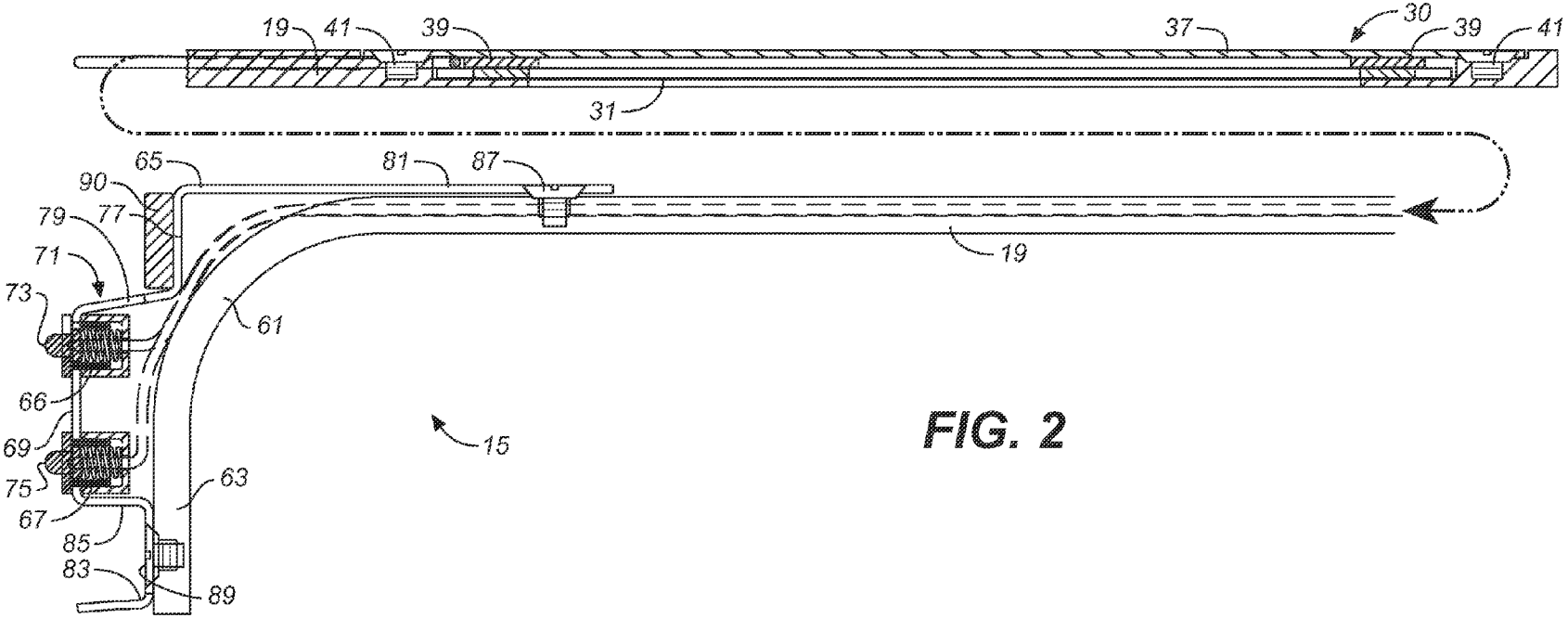
FIG. 2 is an enlarged cross-sectional view of the light module of the configurable planar lighting system shown in FIG. 1.
Figure 3:
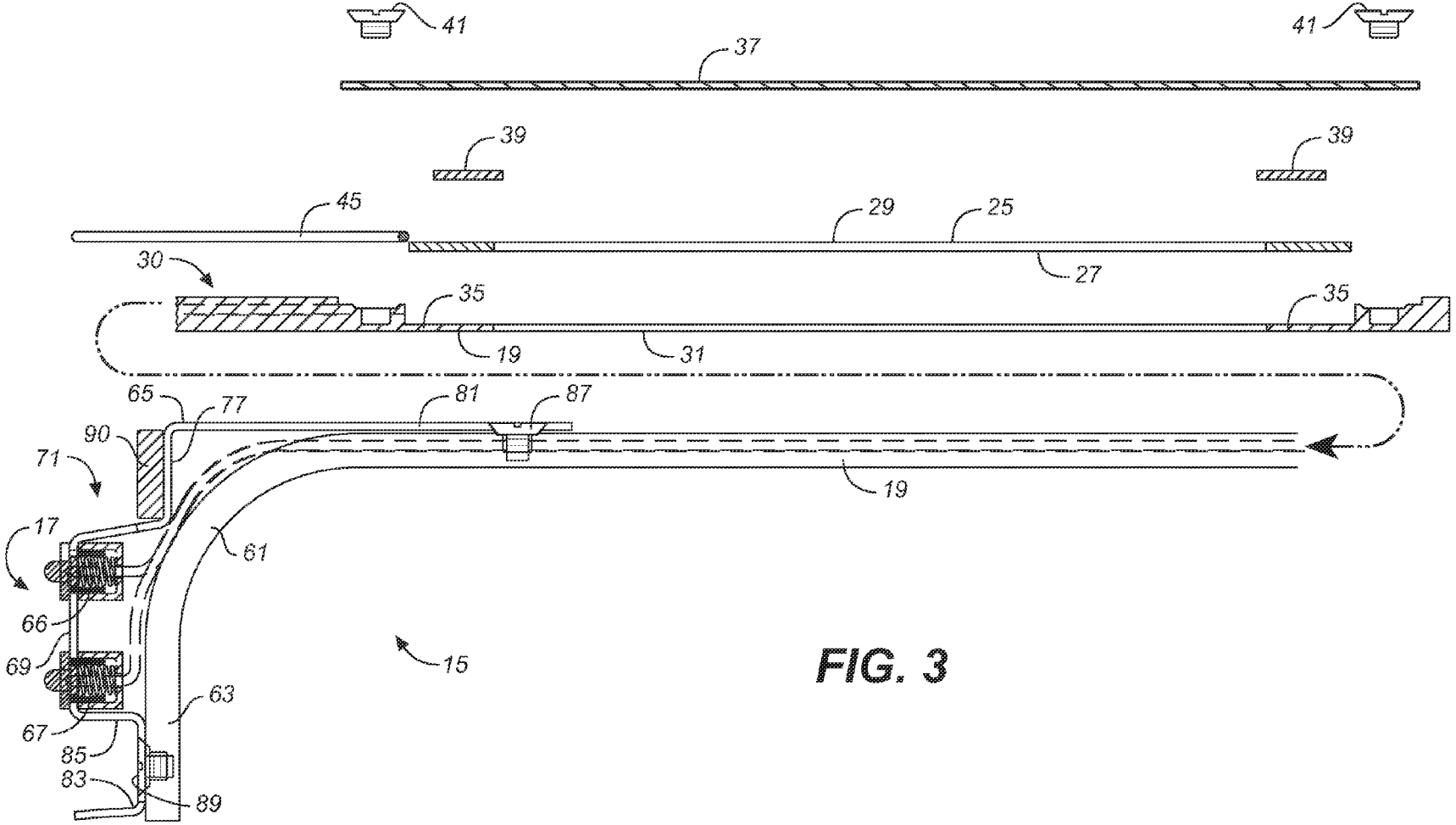
FIG. 3 is an exploded side elevational view of the end of the thin extension plate of the light module shown in FIG. 2, showing both the planar area light source held in the extension plate and the cover for the planar area light source exploded away from the extension plate.
Figure 4:
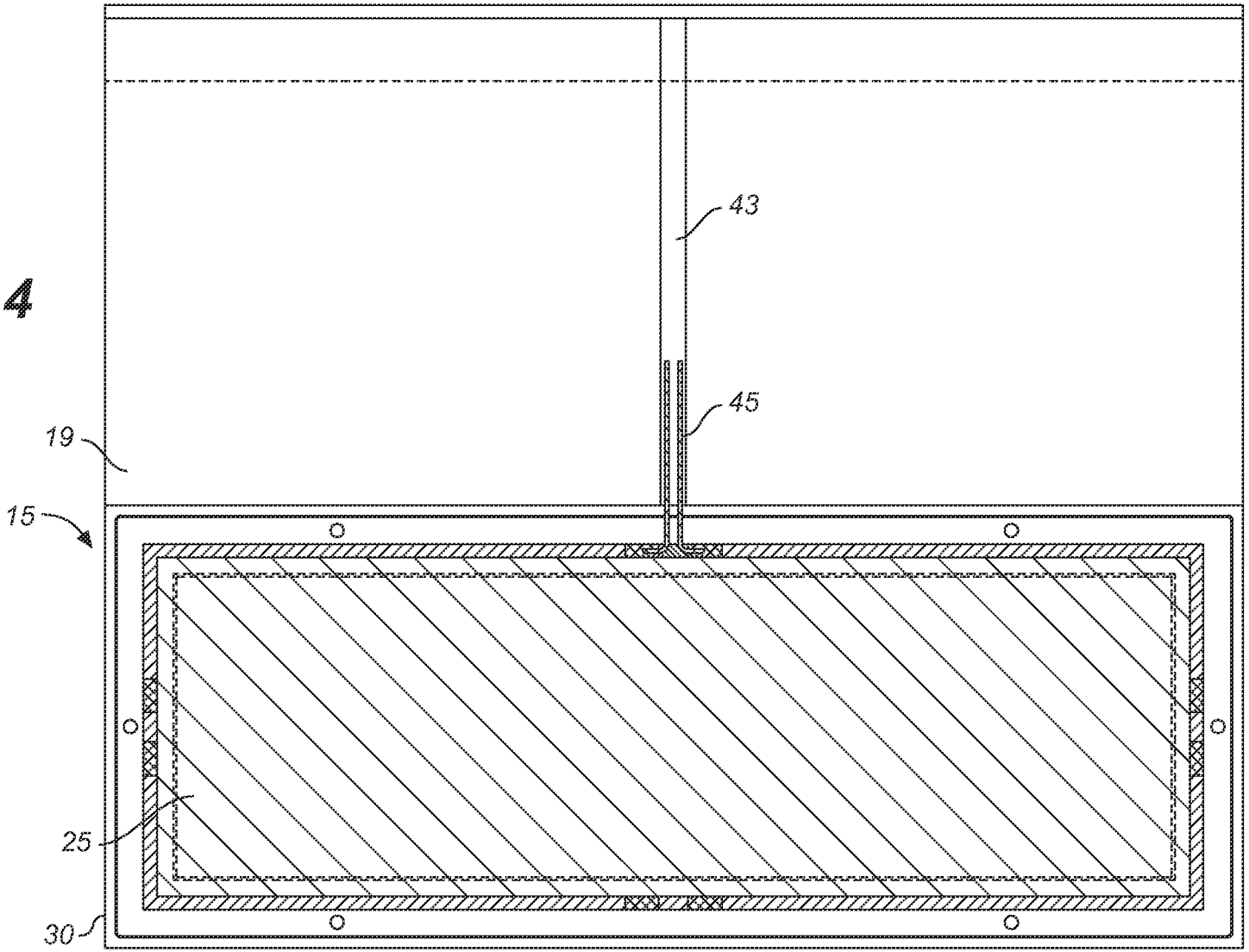
FIG. 4 is a top plan view of the light module shown in the foregoing figures with the cover for the area light source removed.
Figure 5:
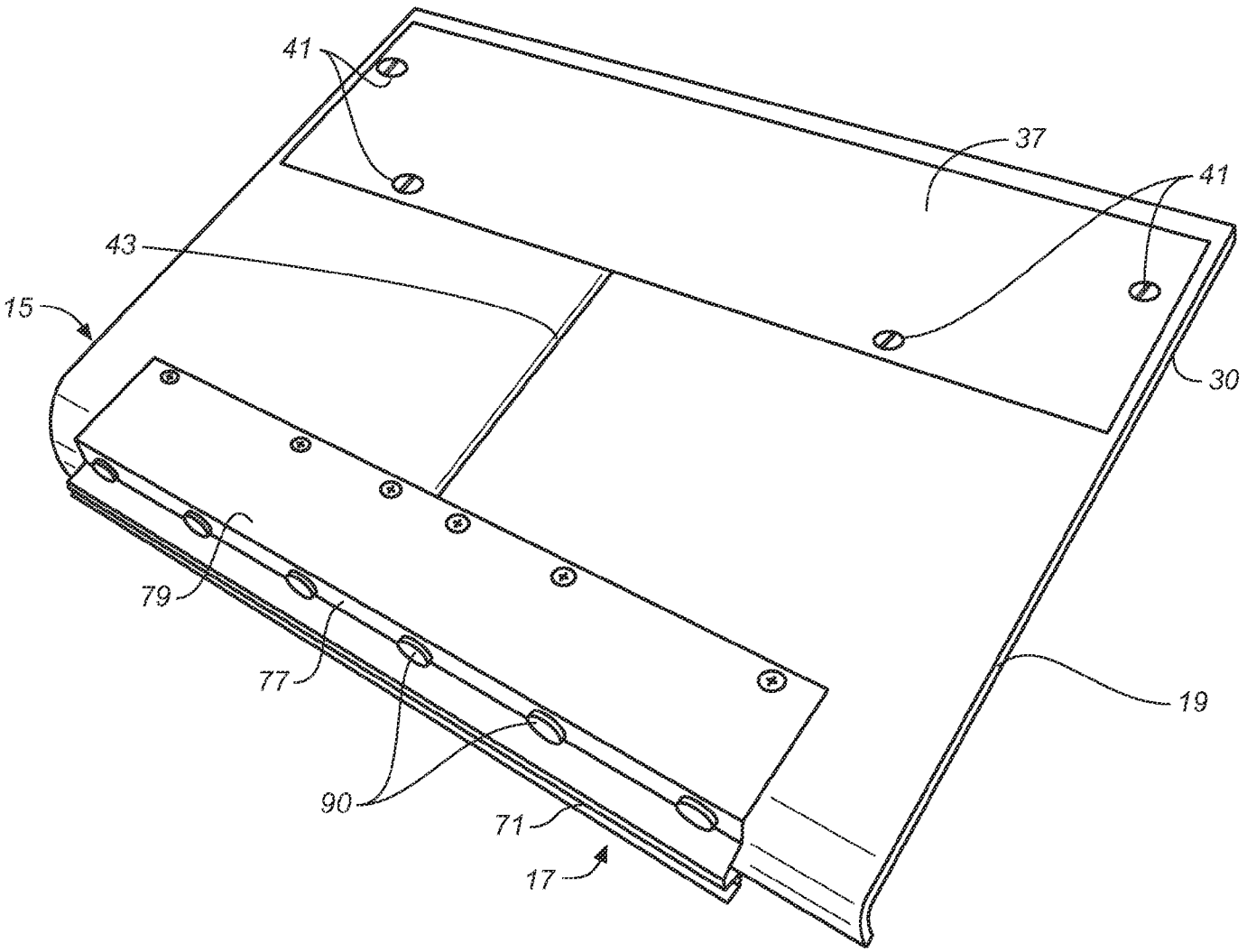
FIG. 5 is a top rear perspective view of a simplified version of a light module such as shown in the foregoing figures.

Referring now to the drawings, FIGS. 1-6 show a configurable planar lighting system 11 comprised of a system track 13 and a light module 15. As later described, the light module can be easily attached to the track, which is elongated, anywhere along the length of the track. Upon attachment to the track the light module will be connected to a source of power for electrifying the module. While the invention could be comprised of just a single light module as hereinafter described, which is attachable at selected positions along track 13, it is contemplated that the system will be comprised of more than one light module that can be adjustably arranged at different locations on the track. Also, while the track described herein is a continuous track which will allow the light module to be attached at any selectable position on the track between the track ends, it will be understood that the track could be non-continuous, that is, designed so that the light module or modules could be attached at only discreet, albeit selectable, locations on the track. It is contemplate that a plurality—by "plurality" it is meant at least two—of similarly constructed light modules would be provided to allow light to not only be moved, but added or subtracted from the area to be illuminated.

Figure 6:
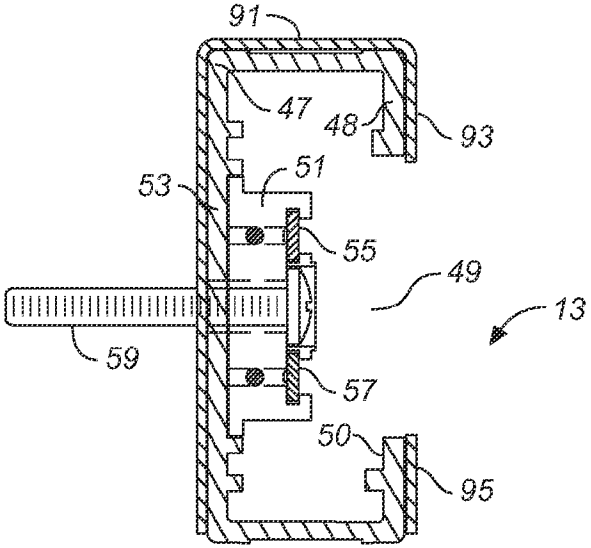
FIG. 6 is a side elevational view in cross-section of the system track of the configurable planar lighting system shown in FIG. 1.
Figure 7:
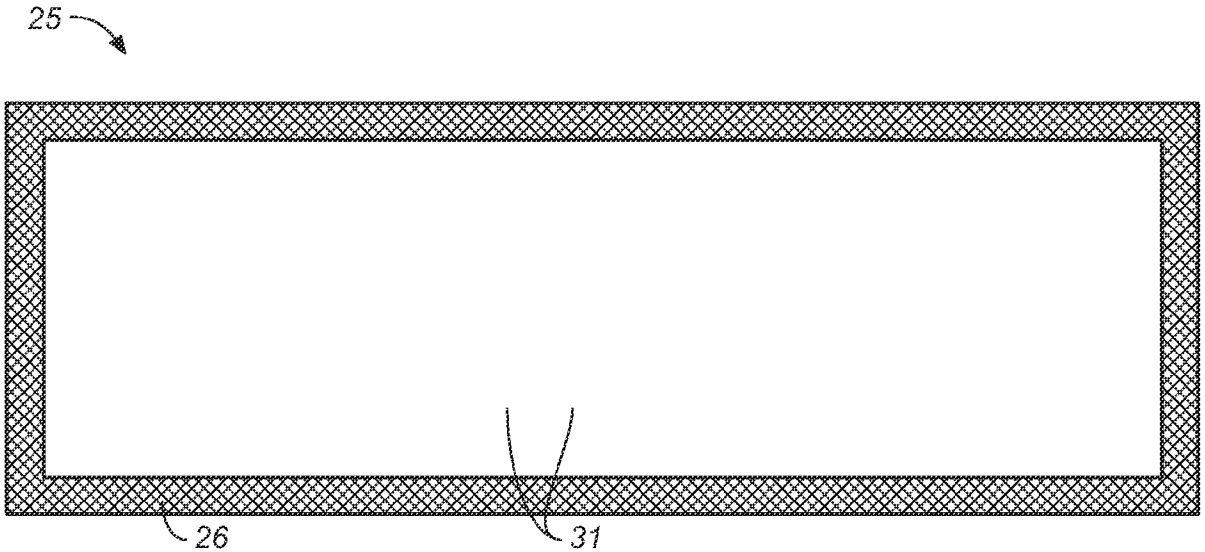
FIG. 7 is a bottom plan view of an area light source (such as an OLED) used in the thin extension plate of the light module shown in FIG. 2.

FIGS. 2-5 best illustrate the system's light module 15, and FIG. 6 best illustrates the system's track 13. Referring to FIGS. 2-5, light module 15 is seen to have a generally rectangular form with an elongated base edge 17 and a thin extension plate 19 that extends in a plane from this base edge. The extension plate has a top side 21 and a bottom side 23 and holds a thin planar area light source, suitably in the form of an OLED panel 25 having a front light emitting side 27 and a non-light emitting back side 29. The thin OLED panel is held, light-emitting side down, over an opening 31 in the extension plate. Preferably, the opening is at the extension plate's distal end 30, and is sized such that all or substantially all of the OLED's light emitting surface 33 is exposed through the plate opening. Recessed shoulders 35 provided around opening 31 support the OLED panel at its perimeter edges, and top cover plate 37 covers the OLED panel and secures it in place. By providing suitable depth to the recessed shoulder, both the OLED and the cover plate can fit into the recess formed by the recessed shoulders so that the top of the cover plate is flush with the top of the extension plate. Resilient pads 39 preferably placed around the perimeter edge of the OLED panel provide a cushion between the cover plate and the OLED. (Alternatively, the pads could be replaced by a gasket.) It is seen that the cover plate can be secured in place by suitable fasteners such as screw fasteners 41 that screw into screw holes in the recessed shoulder of opening 31.

By holding the OLED panel in the extension plate of the light module as above-described, light will be emitted from the bottom of the extension plate when the OLED is "switched on" to light a task or display beneath the extension plate. One or more wire channels, such as the illustrated wire channel 43 running down the top side of the extension plate 19, can be provided for wiring the OLED panel to the base edge of the light module. The OLED panel's wire leads 45 can be extended down wire channel 43 and connected to the electrical contacts in the module's base edge 17. The wire channel could be covered, such as by electrical tape, to hold the wires in place.

While the OLED panel is shown mounted in the distal end of the light module's extension plate, it will be understood that the OLED could be located elsewhere on the extension plate, such as the inboard end of the plate or in the middle of the plate. However, by locating the OLED panel at the distal end of the extension plate, the task or display lighting can advantageously be moved away from the vertical structure to which the light system is mounted.

The mounting of the light module to a vertical structure, such as a wall or panel, via the track 13 is shown in FIG. 1 and in more detail in FIG. 6. The track is an elongated track having a C-shaped channel housing 47 preferably having a uniform cross-sectional shape, suitably an extruded aluminum part cut to a desired length. The channel housing has a front channel opening 49 for receiving the base edge of the light module 15, and an insulator block 51 is mounted to the back wall 53 of the channel housing behind this front opening. Insulator block 51 supports upper and lower conductor strips 55, 57 to position the conductor strips in opposition to the front channel opening. The conductor strips can run substantially the length of the track so they can be contacted anywhere along the length of the track. External wires or other conductive elements can be connected to the tracks conductor strips for placing the conductor strips in electrical communication with an external power source when the track is mounted to a wall, panel or vertical structure, such as by mounting bolts 59.

The base edge 17 of the light module is designed to be easily mounted to the track and preferably to be held on the track without mechanical connectors. In the illustrated embodiment, the foundation of both the base edge and extension plate of the light module is seen to be a bent and L-shaped plate 61, wherein the long leg of the plate is the foundation for the module's extension plate 19 and the short leg of the plate (denoted by the numeral 63) is the foundation for the module's base mounting edge. The L-shaped plate is most suitably bent such that the short and long legs thereof are at a ninety angle relative to each other, however, it is completed that bend angles could be used. The module's base edge 17 can further include an edge bracket 65 (there could be more than one edge bracket) for holding upper and lower electrical contacts, such as the illustrated upper and lower spring loaded contacts 66, 67, and for providing an adaptive structure that can be used to join the base edge of the module to system track 13. Upper and lower electrical contacts 66, 67 are attached to the end wall 69 of the U-shaped forwardly projecting portion 71 formed in the edge bracket in a spaced relationship that will cause the depressible ends 73, 75 of the contacts to contact the upper and lower conductor strips 55, 57 in the channel housing of track 13 when the projecting portion 71 formed by edge bracket 65 is inserted into the front channel opening 49 of the track's channel housing 47. In addition to making electrical connection with the system track, the bracket's projecting portion provides a structure at the base edge of the light module that allows light modules to be easily engaged with the system track anywhere along the track with each module being in common plane alignment with other light modules.

The edge bracket 65 at the base edge of the light module 15 further includes a shoulder portion 77 extending upwardly from the top wall 79 of the bracket's projecting portion 71, and an upper horizontal leg portion 81 extending from the top of this shoulder portion. In addition, a bottom leg portion 83 extends downwardly from the bottom wall 85 of the projecting portion. The leg portions 81 and 83 of the edge bracket can be fastened to the two arms of the bent plate 61 by fastening means, such as screw fasteners 87, 89.

As mentioned above, the track shown in the illustrated embodiment is a continuous track designed to allow the light module to be connected to the track at any location along its length so that the light module is infinitely adjustable along the track. In the illustrated embodiment the light module is held on the continuous track by magnetic connection means rather than by mechanical connections. This is achieved by a base edge magnetic attracting means such as magnets 90 affixed to the outside of the top shoulder portion 77 of edge bracket 65 forming part of the module's base edge 17. A magnetic material is provided along the length of the track such that, when the base projection of the base edge of the light module is inserted into the front channel opening 49 of the channel housing, the base edge magnets 90 will be in opposition to, and thus attracted to, the channel housing's magnetic material. In the illustrated embodiment, the magnetic material is provided on the track's channel by means of a magnetic cover plate 91 on the outside of the channel housing. Magnetic cover plate 91 can suitably wrap over the top of the track's channel housing and will suitably extend substantially the entire length of the system track.

As best seen in FIG. 6, the top front edge 93 of magnetic cover plate 91 extends down over the top front edge wall 48 of the channel housing such that it faces the base edge magnets 90 of the light module when the light module is engaged in the track. This advantageously provides an attraction force at the top of the light module's base edge. The bottom leg portion 83 of edge bracket 65 can be provided with a cup shape as shown so that it engages over the bottom front edge wall 50 of the track channel housing when the base edge of the light module is placed in the track. The magnetic attraction at the top of the track combined with the mechanical retention at the bottom of the track will keep the relatively light weight planar light module on the track until a pulling force sufficient to break the magnetic attraction is applied to the top of the light module. It is noted that a spacer 95 can be provided on the outside of the bottom front edge wall 50 of the track channel housing to compensate for the thickness added to the housing's top front edge wall 48 by magnetic cover plate 91.

Figure 8:
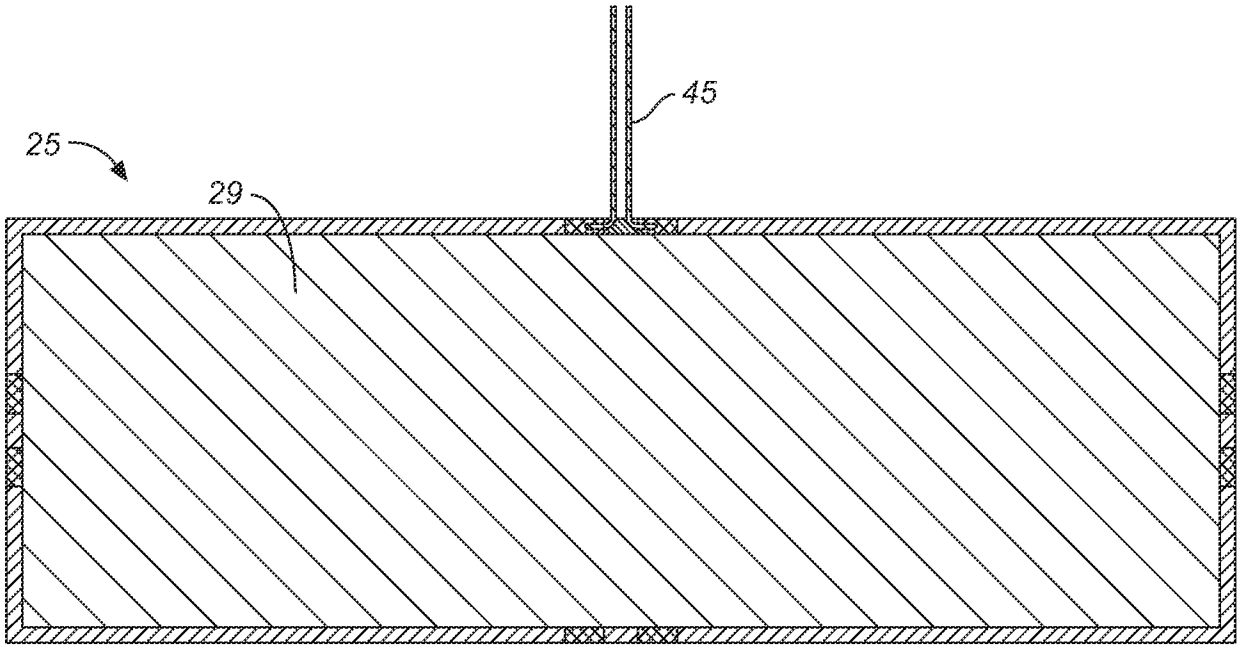
FIG. 8 is a top plan view thereof.
Figure 9:
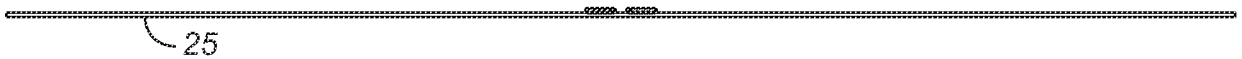
FIG. 9 is a side elevational view thereof showing the thinness of the area light source.

FIGS. 8 and 9 show the OLED panel 25, which is placed in the extension plate 19 of light module 15 as above-described. FIG. 9 shows the extreme thinness of the OLED panel, which allows it to fit within the very thin extension plate of the light module. A suitable thickness for the OLED panel can be about 1/16 inch, while the thickness of the module's extension plate (denoted by the letter "T" in FIG. 1) will preferably be no greater than about ¼ inch, and suitably about 0.156 inches. The lateral dimensions of the OLED panel can be about 4 inches by 12 inches to fit within the distal end of a light module's plate extension, with the extension plate of the light module suitably measuring about 11 inches in depth and 13½ inches in width. Such dimensions will allow the light module to fit underneath a 12 inch shelf or cabinet.

Figure 10:
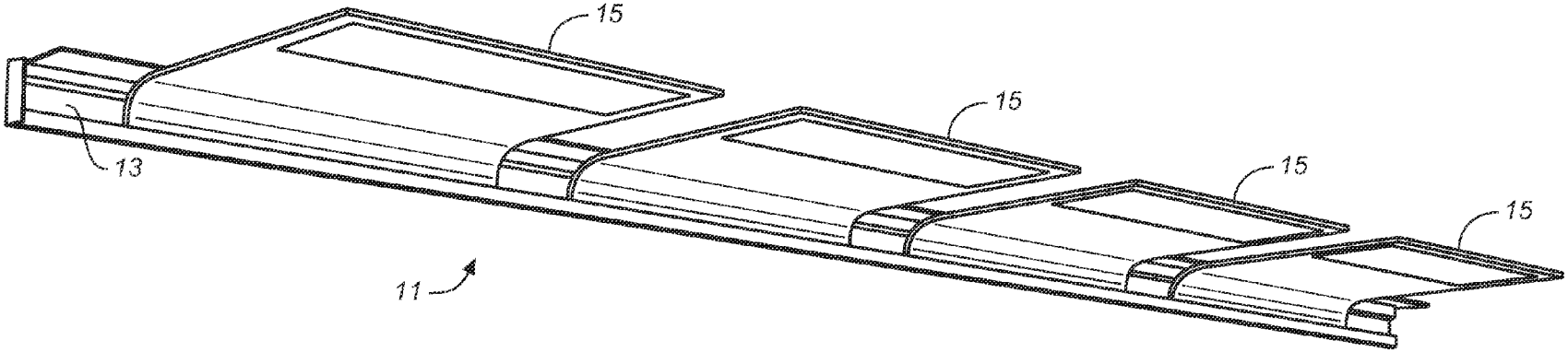
FIG. 10 is a pictorial illustration of a configurable planar lighting system in accordance with the invention mounted to a wall, and showing a system with a plurality of light modules.
Figure 11:
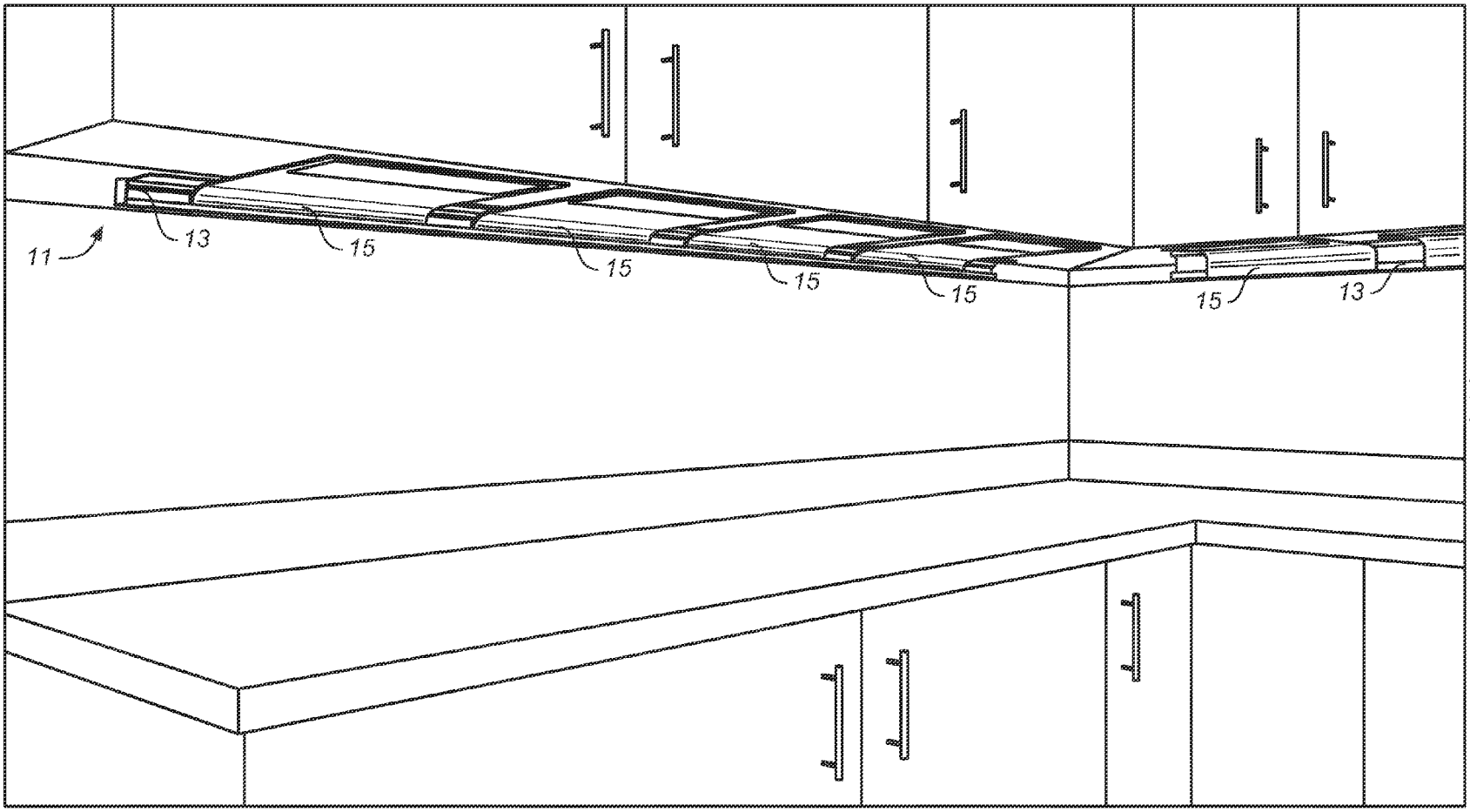
FIG. 11 is a pictorial illustration of a configurable planar lighting system in accordance with the invention mounted beneath cabinets.
Figure 12B:
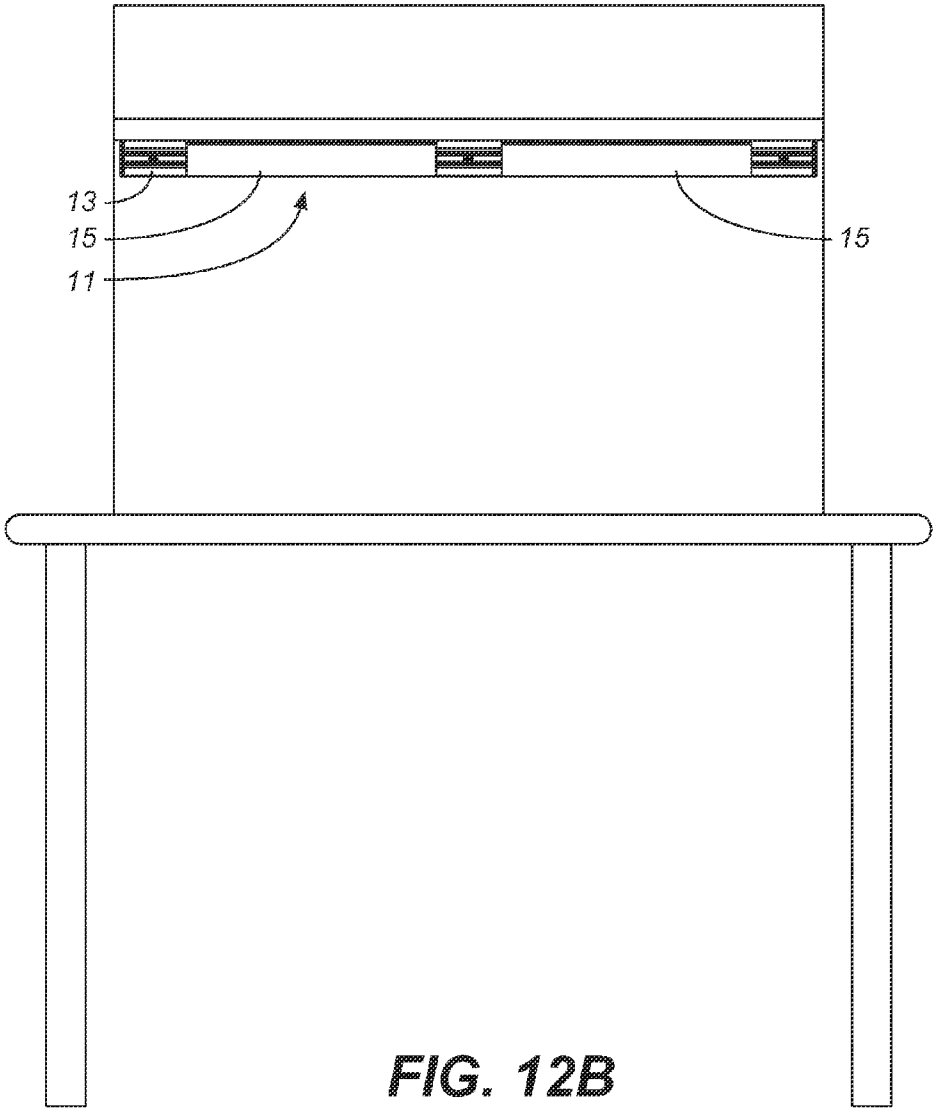
FIGS. 12A and 12B are graphical illustrations of a configurable planar lighting system in accordance with the invention mounted under a desk shelf.
Figure 12A:
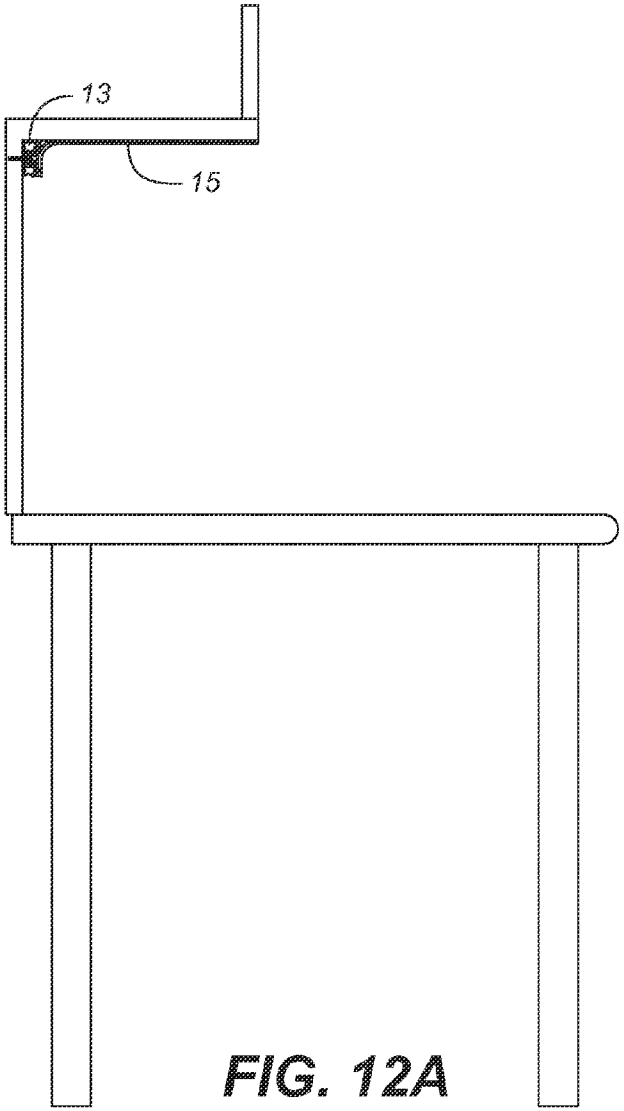

FIGS. 10-12B illustrate different uses of the configurable planar lighting system of the invention. In each it seen that the thin, flat extension plates of the light modules align in a common plane. FIG. 10 shows multiple light modules 15 attached to a track 13 mounted to a wall (not shown), so that the thin extension plates of the light modules simply project in a shelf-like fashion perpendicularly from a wall. FIG. 11 shows the configurable planar lighting system with multiple light modules fitted on a common plane beneath cabinets above a countertop such that the thin extension plates of the light modules extend under the cabinets, where they are not seen at normal viewing angles. FIGS. 12A and 12B show the configurable planar lighting system mounted below the shelf of a desk such that the thin extension plates of the light modules (two of them) extend in a common plane under the shelf of the desk, again hidden from view. In each of these examples, individual light modules can be removed from and/or laterally adjusted along the track to configure the system to meet particular lighting needs.

While the illustrated configurable planar lighting system shows light modules having downwardly facing OLED panels for providing task or display lighting below the light modules, it is contemplated that for certain applications, for example in a wall mounted system as shown in FIG. 10, a configurable planar lighting system in accordance with the invention could be provided having an upwardly facing area light source or both upwardly and downwardly facing, suitably back-to-back, thin area light sources. The upwardly facing area light source could, for example, illuminate light objects placed on top of the extension plates of light modules to create a pleasing aesthetic lighting effect.

While illustrated embodiments of the invention have been described in considerable detail in the foregoing specification, it is not intended that the invention be limited to such details, which are provided for illustrative purposes.

What we claim is:

1. A configurable planar lighting system comprising:

an elongated system track having a length and adapted for mounting to a surface, and having electrical conductors in electrical communication with an external power source, at least one light module having a base edge and a thin extension plate extending in a plane from said base edge, said extension plate having a top side and a bottom side, and said base edge being configured to connect to the system track at different selectable positions along the length thereof such that, when connected to said system track, the light module projects from said system track in a plane, and said light module further including a thin planar area light source mounted to at least one of the bottom or top sides of the extension plate of the light module so as to be in co-planar relation with said extension plate and so as to emit light from the plane of the light module.

2. The configurable planar lighting system of claim 1 wherein said elongated system track is a substantially continuous track which will allow the light module to be attached at substantially any selectable position on the track.

3. The configurable planar lighting system of claim 1 wherein said light module is connected at selected positions to said elongated system track by magnetic connection means.

4. The configurable planar lighting system of claim 1 wherein the base edge and extension plate of said light module are formed at least in part by an L-shaped bent plate having a short leg forming at least in part the base edge of said light module and a long leg forming at least in part the extension plate thereof.

5. The configurable planar lighting system of claim 1 wherein said light module further includes an edge bracket, at least a portion of which forms the base edge of the light module and which provides an adaptive structure for connecting the base edge of said light module to the system track at different selectable positions along the length thereof.

6. The configurable planar lighting system of claim 1 wherein said light module further includes electrical contacts at the base edge of said light module, said electrical contacts being electrically connected to the thin planar area light source of said light module, and being disposed for contacting the electrical conductors of the system track when the base edge of said light module is connected to said system track.

7. The configurable planar lighting system of claim 6 wherein said electrical contacts are spring loaded electrical contacts.

8. The configurable planar lighting system of claim 1 wherein the extension plate of said light module has a distal end and the thin planar area light source is located at the distal end of said extension plate.

9. The configurable planar lighting system of claim 1 wherein:

said system track is comprised of a channel housing having a front opening and an outside, the electrical conductors of said system track are positioned behind the front opening of said channel housing, electrical contacts are provided at the base edge of said light module, and the base edge of said light module has a projecting portion configured for insertion into the system track's channel housing through the front opening thereof, such that the electrical contacts at the base edge of said light module contact the electrical conductors of said system track when the projecting portion of the base edge of the light module is inserted into the channel housing.

10. The configurable planar lighting system of claim 9 wherein:

a magnetic material is provided on the outside of said channel housing, and base edge magnetic attracting means are provided on the base edge of said light module outside of the projecting portion thereof, said base edge magnetic attracting means being positioned in opposition to the magnetic material on the outside of said channel housing when the projecting portion of the base edge of the light module is inserted into the channel housing, such that, when the projecting portion of the base edge of the light module is inserted into the channel housing, the light module is held to the system track by the magnetic attraction between the base edge magnetic attracting means of the light module and magnetic material on the outside of the channel housing of the system track.

11. A configurable planar lighting system comprising:

an elongated system track having a length and adapted for mounting to a surface, and having electrical conductors which extend for substantially the length of the elongated system track and which are in electrical communication with an external power source, a plurality of light modules, each of said light modules having a base edge and a thin extension plate extending in a plane from said base edge, said extension plate having a top side and a bottom side, and said base edge being configured to connect to the system track at different selectable positions along the length thereof such that, when connected to said system track, light modules project from said system track in a plane, each of said light modules further including a thin planar area light source mounted to at least one of the bottom or top sides of the extension plate of each of said light modules so as to be in co-planar relation with said extension plate and so as to emit light from the plane of the light module, and each of said light modules having electrical contacts at the base edge thereof, said electrical contacts being electrically connected to the thin planar area light source of said light module, and being disposed for contacting the electrical conductors of the system track when the base edge of said light module is connected to said system track, and said elongated track being a substantially continuous track which allows the light modules to be connected to the system track at substantially any selectable position along the system track, and such that an electrical connection is made between the electrical contacts of the light modules and the electrical conductors of the system track when the light modules are connected to the selected position on the track.

12. The configurable planar lighting system of claim 11 wherein each of said plurality of light modules is configured such that, when connected to the system track, the thin extension plates thereof align in a common plane.

13. The configurable planar lighting system of claim 11 wherein each of said light modules is connected to said elongated system track by magnetic connection means.

14. The configurable planar lighting system of claim 11 wherein the base edge and extension plate of each of said light modules are formed at least in part by an L-shaped bent plate having a short leg forming at least in part the base edge of said light module and a long leg forming at least in part the extension plate thereof.

15. The configurable planar lighting system of claim 11 wherein each of said light modules further includes an edge bracket, at least a portion of which forms the base edge of the light module and which provides an adaptive structure for connecting the base edge of said light modules to the system track at different selectable positions along the length thereof.

16. The configurable planar lighting system of claim 11 wherein said electrical contacts are spring loaded electrical contacts.

17. The configurable planar lighting system of claim 11 wherein the extension plate of each of said light modules has a distal end and the thin planar area light sources of said light modules are located at the distal ends of said extension plates.

18. A configurable planar lighting system comprising:

an elongated magnetic system track having a length and adapted for mounting to a surface, a plurality of light modules, each of said light modules having an elongated base edge and a thin extension plate extending in a plane from said elongated base edge, said extension plate having a top side and a bottom side, and said base edge being configured to magnetically connect to the system track at substantially any selectable positions along the length thereof such that, when connected to said system track, the light modules project from the track in a common plane, and each of said light modules including a thin planar area light source mounted to at least one of the bottom or top sides of the extension plate of each of said light modules so as to be in co-planar relation with said extension plate and so as to emit light from the plane of the light module.

19. The configurable planar lighting system of claim 18 wherein:

said system track is comprised of a channel housing having a front opening and an outside, the elongated base edge of each of said light modules each has a projecting portion configured for insertion into said channel housing through the front opening thereof, a magnetic material is provided on the outside of the channel housing of said system track, and base edge magnetic attracting means are provided on the elongated base edge of each of said light modules outside of the projecting portion thereof, the base edge magnetic attracting means of each light module being positioned on the light modules so that the base edge magnetic attracting means of the light module is in opposition to the magnetic material on the outside of said channel housing when the projecting portion of the base edge of the light module is inserted into the channel housing of the system track through the front opening thereof, such that, when the projecting portion of the base edge of the light module is inserted into the channel housing, the light module is held to the system track by the magnetic attraction between the base edge magnetic attracting means of the light module and the magnetic material on the outside of the channel housing of the system track.

20. The configurable planar lighting system of claim 18 wherein the extension plates of each of said light modules has a distal end and the thin planar area light sources of said light modules are located at the distal ends of said extension plates.

21. A configurable planar lighting system comprising:

an elongated system track having a length and adapted for mounting to a surface, said system track including a channel housing having a front opening and an outside, electrical conductor strips positioned behind the front opening of said channel housing and extending substantially the entire length of the system track, at least one light module having an elongated base edge and a thin extension plate extending in a plane from said elongated base edge, the extension plate of each light module having a top side and a bottom side, and said elongated base edge having a projecting portion configured for insertion into the channel housing of the system track through the front opening thereof and at any selectable position along the length of the channel housing, such that, when connected to said system track, the light module projects from the channel housing of the system track in a plane, and said light module further including a thin, planar area light source mounted to at least one of the bottom or top sides of the extension plate of said light module so as to be in co-planar relation with said extension plate and so as to emit light from the plane of the light module, the projection portion of the elongated base edge of said light module containing electrical contacts electrically connected to the thin planar area light source of said light module and disposed for contacting the electrical conductor strips of the system track when the base edge of said light module is connected to the system track.

22. The configurable planar lighting system of claim 21 wherein the base edge and extension plate of said light module is formed at least in part by an L-shaped bent plate having a short leg forming at least in part the base edge of said light module and a long leg forming at least in part the extension plate thereof.

23. The configurable planar lighting system of claim 22 wherein said light module further includes an edge bracket attached to said L-shaped bent plate, at least a portion of said edge bracket forming the projection portion of the elongated base edge of said light module.

24. A planar form light module for a configurable planar lighting system having an elongated system track adapted for mounting to a surface, said light module comprising:

an elongated base edge, a thin extension plate extending in a plane from said base edge, said extension plate having a top side and a bottom side, and a thin planar area light source mounted to at least one of the bottom or top sides of the extension plate of said light module so as to be in co-planar relation with said extension plate and so as to emit light from the plane of the light module, said elongated base edge being configured to connect to the system track of the lighting system at different selectable positions along the length thereof, such that, when connected to the system track of the lighting system, the light module will project from the system track of the lighting system in a plane.

25. The light module of claim 24 wherein the base edge and extension plate of said light module are formed at least in part by an L-shaped bent plate having a short leg forming at least in part the base edge of said light module and a long leg forming at least in part the extension plate thereof.

26. The light module of claim 24 further comprising an edge bracket, at least a portion of which forms the base edge of the light module and which provides an adaptive structure for connecting the base edge of the light module to the system track of the lighting system at different selectable positions along the length thereof.

27. The light module of claim 24 wherein the extension plate of the light module has a distal end and the thin planar area light source is located at the distal end of said extension plate.

* * * * *